US009631363B2

(12) United States Patent
Lee et al.

(10) Patent No.: US 9,631,363 B2
(45) Date of Patent: Apr. 25, 2017

(54) STEEL PLATE STRUCTURE AND STEEL PLATE CONCRETE WALL

(71) Applicants: Korea Hydro & Nuclear Power Co., Ltd., Gangnam-du (KR); Korea Power Engineering Company, Inc., Yongin Gyeonggi-Do (KR)

(72) Inventors: Han-Woo Lee, Daejeon (KR); Jong-Bo Lee, Daejeon (KR); Jong-Hak Kim, Daejeon (KR); Ung-Kwon Lee, Seoul (KR); Tae-Youp Mun, Yongin-si (KR); Won-Sang Sun, Gwacheon Gyeonggi-Do (KR); Jin-Woo Lee, Seongnam Gyeonggi-Do (KR); Tae-Young Kim, Suwon (KR)

(73) Assignees: Korea Hydro & Nuclear Power Co., Ltd., Seoul (KR); Korea Power Engineering Company, Inc., Yongin Gyeonggi-Do (KR)

( * ) Notice: Subject to any disclaimer, the term of this patent is extended or adjusted under 35 U.S.C. 154(b) by 8 days.

(21) Appl. No.: 14/621,213

(22) Filed: Feb. 12, 2015

(65) Prior Publication Data

US 2015/0159372 A1 Jun. 11, 2015

Related U.S. Application Data

(62) Division of application No. 12/452,300, filed as application No. PCT/KR2008/003697 on Jun. 26, 2008, now abandoned.

(30) Foreign Application Priority Data

Jun. 27, 2007 (KR) ..... 10-2007-0063845

(51) Int. Cl.
*E04B 2/02* (2006.01)
*E04B 2/40* (2006.01)
(Continued)

(52) U.S. Cl.
CPC ..... *E04B 2/40* (2013.01); *E04B 2/562* (2013.01); *E04B 2/58* (2013.01); *E04B 2/8635* (2013.01)

(58) Field of Classification Search
CPC .... E04B 2002/56; E04B 2002/86; E04B 2/56; E04B 2/562; E04B 2/58; E04B 2/60
(Continued)

(56) References Cited

U.S. PATENT DOCUMENTS 4,178,729 A 12/1979 Jennings
5,653,082 A 8/1997 Shinoda et al.
(Continued)

FOREIGN PATENT DOCUMENTS

EP 0752037 A1 1/1997
GB 2258669 A 2/1993
(Continued)

OTHER PUBLICATIONS

Indian Office Action dated Feb. 23, 2015 for Indian Application No. 2364/MUMNP/2009.
(Continued)

*Primary Examiner* — William Gilbert
(74) *Attorney, Agent, or Firm* — Locke Lord LLP

(57) ABSTRACT

A steel plate structure and a steel plate concrete wall are disclosed. A steel plate structure, which includes: a pair of steel plates, which are separated to provide a predetermined space; a structural member, which is positioned in the predetermined space, and which is structurally rigidly joined to one side of the steel plate in the direction of gravity; and a strut, which maintains a separation distance between the pair of steel plates, can be utilized to reduce the overall thickness of a steel plate concrete wall for efficient use of space, and to reduce the thickness of the steel plates for better welding properties and larger unit module sizes. Also,
(Continued)

the axial forces or lateral forces applied on the steel plate concrete wall may be effectively resisted.

10 Claims, 11 Drawing Sheets

(51) Int. Cl.
*E04B 2/86* (2006.01)
*E04B 2/56* (2006.01)
*E04B 2/58* (2006.01)

(58) Field of Classification Search
USPC ..... 52/424, 426, 431, 434, 435, 378, 421, 52/425, 427, 428, 439, 442
See application file for complete search history.

(56) References Cited

U.S. PATENT DOCUMENTS

| | | | | |
|---|---|---|---|---|
| 6,041,561 | A | 3/2000 | LeBlang | |
| 6,401,417 | B1 * | 6/2002 | Leblang | 52/481.1 |
| 6,570,950 | B1 | 5/2003 | Matteson | |
| 7,516,589 | B2 * | 4/2009 | Messiqua et al. | 52/646 |
| 2007/0151192 | A1 * | 7/2007 | Herren | 52/634 |

FOREIGN PATENT DOCUMENTS

| | | | |
|---|---|---|---|
| JP | 1984-233075 | * | 12/1984 |
| JP | 10-160881 | | 6/1998 |
| JP | 2000170285 | A | 6/2000 |
| JP | 2005-094931 | A | 4/2005 |
| JP | 2007063954 | A | 3/2007 |
| KR | 10-2003-36380 | | 5/2003 |

OTHER PUBLICATIONS

Korean Office Action dated Apr. 31, 2008 for Korean Application No. 2007-0063845.
Chinese Office Action dated Aug. 4, 2010, for corresponding Chinese Patent Application No. 200880021644.1.
Third Party Observations filed by Tata Steel UK Ltd in EP Application No. 08778388 dated Aug. 24, 2012.
Chinese Office Action dated Jul. 1, 2013 for corresponding Chinese Patent Application No. 200880021644.1.
Extended European Search Report for EP Appln. No. 08778388.2.
Chinese Office Action dated Mar. 7, 2014 issued on corresponding Chinese Patent Application No. 200880021644.1.
Core Group plc, Corefast 2007.
Corus Group plc. The Bi-Steel construction panel 2003.
Corus Group plc, Adaptable Bi-design 2005.
European Office Action for EP Appln. No. 08 778 388, dated May 27, 2015.

* cited by examiner

STEEL PLATE STRUCTURE AND STEEL PLATE CONCRETE WALL

CROSS-REFERENCE TO RELATED APPLICATIONS

This application is a Divisional Application of U.S. application Ser. No. 12/452,300, filed Dec. 22, 2009, which is a national phase under 35 U.S.C. §371 of PCT International Application No. PCT/KR2008/003697, filed Jun. 26, 2008, which claims the benefit of Korean Patent Application No. 10-2007-0063845, filed Jun. 27, 2007, the entire contents of the aforementioned application are hereby incorporated herein by reference.

TECHNICAL FIELD

The present invention relates to a steel plate structure and a steel plate concrete wall. More particularly, the present invention relates to a steel plate structure and a steel plate concrete wall that include a load-bearing structural member, in addition to the steel plate and concrete, so as to reduce the thickness of the steel plate structure and steel plate concrete wall.

BACKGROUND ART

As current structures are becoming taller and larger, it is becoming more important to provide higher strength and improved workability. For reinforced concrete structures, steel frame structures, and steel framed reinforced concrete structures, etc., which have been in common use until now, a structure may be constructed by assembling mold forms and steel rods or steel frames, etc., and casting the concrete directly at the construction site, so that the construction times may be increased and the quality may be made less reliable. As an alternate to such structures, the steel plate concrete structure (hereinafter referred to as "SC structure") is receiving attention, which is made by filling concrete inside steel plates so that the steel plates restrict the concrete, and which provides desirable properties in terms of strength, load-bearing, strain characteristics, and workability, etc.

The SC structure is a system in which concrete is filled in between two steel plates, with studs and tie bars, etc., arranged such that the concrete and the steel materials move together, so that the steel materials and the concrete may move as an integrated body. In particular, the SC structure can be utilized in the construction of large structures such as nuclear power plants, etc., to reduce construction times by way of modularization.

FIG. 1 illustrates a steel plate structure according to prior art, before the concrete is cast. Hereinafter, the steel structure made of steel plates, etc., before casting concrete in a SC structure wall will be referred to as a "steel plate structure."

The SC structure wall constructed using a steel plate structure according to prior art may be formed by vertically arranging steel plates 102 at both surfaces of the wall that is to be formed, installing a number of studs 104 on the inner surfaces of the steel plates 102 in order to facilitate the attachment between the steel plates 102 and the concrete, connecting the two steel plates 102 using rod-shaped struts 106 so as to secure the two steel plates 102, and then casting concrete in the space between the steel plates 102. When the inside of the steel plates 102 is filled with concrete in the SC structure wall, even if a failure occurs in the concrete, the steel plates 102 continue to restrict the concrete, to provide a greater level of load-bearing. Also, as the concrete is placed inside the steel plates 102, the concrete can be prevented from being degraded by the external environment, so that the durability of the structure can be improved.

However, when using a steel plate structure according to prior art in forming a SC structure wall for a large structure, such as a skyscraper and a nuclear power plant, etc., the thickness of the wall having a SC structure may be increased, leading to spatial limitations. Also, due to the greater amount of loads that must be supported, the steel plates and concrete may have to be increased in thickness, where the greater thickness for the steel plates may lead to increased thermal deformations when welding the steel plates, as well as to a need for thermal post-treatment. In the case of a skyscraper or a nuclear power plant structure, in particular, the axial forces applied by the weight of the structure and the lateral forces caused by earthquakes must be resisted in an efficient manner, but as the concrete inside the steel materials has a low shear strength, the remaining shear strength has to be resisted by the steel plates. In order to bear the lateral forces caused by earthquakes, the thickness of the steel plates may have to be increased.

Also, when modularizing the steel plate structure according to prior art and assembling the modules on site to form a wall, the steel plates of the unit modules may be welded together to attach the unit modules, or extra plates or couplers may be used in addition to the welding of the steel plates to enhance the adhesion strength between the unit modules. However, the extra plates or couplers may be exposed at the exterior surface to degrade the appearance, and the addition of secondary work may lead to longer construction periods. Furthermore, temporary reinforcement material may have to be additionally attached during the transporting of the unit modules to the construction site, in order to prevent deformations in the steel plate structure.

When installing a bracket used for installing an external device, such as piping, etc., to the exterior of the SC structure wall, the bracket may be welded or coupled with bolts, but when a large external device having a heavy mass is installed to the bracket, local deformations may occur in the steel plate, and the load-bearing performance may be degraded, so that the external equipment may not be installed on the outside of the wall.

Also, when casting concrete in the steel plate structure according to prior art, since the two steel plates are connected only by the rod-like struts, there is a risk that the steel plates may be deformed by the transverse pressure of the unhardened concrete.

DISCLOSURE

Technical Problem

An aspect of the present invention is to provide a steel plate structure and a steel plate concrete wall that include load-bearing structural members, in addition to the steel plates and concrete, to reduce the thickness of the steel plate concrete wall and the thickness of the steel plates, while effectively resisting the axial forces or lateral forces acting on the wall.

Another aspect of the present invention is to provide a steel plate structure and a steel plate concrete wall that allows easy attachment between the steel plate structure unit modules, in cases where the steel plate structure is manufactured as a unit module.

Yet another aspect of the present invention is to provide a steel plate structure and a steel plate concrete wall that are capable of supporting a large external device having a heavy mass using the steel plates and structural members.

Technical Solution

An aspect of the present invention provides a steel plate structure that includes: a pair of steel plates, which are separated to provide a predetermined space; a structural member, which is positioned in the predetermined space, and which is structurally rigidly joined to one side of the steel plate in the direction of gravity; and a strut, which maintains a separation distance between the pair of steel plates.

The steel plate structure can further include studs protruding from one side of the steel plate.

A multiple number of structural members can be coupled, while the steel plate structure can further include a horizontal connector that interconnects the end portions of the multiple structural members. Also, a vertical connector can further be included that is coupled to an end portion of one side of the steel plate in the direction of gravity.

The structural member can be coupled to one side of the steel plate by welding.

The structural member can include a pair of opposing structural members each coupled to one side of each of the pair of steel plates. In this case, the strut may be coupled between the pair of structural members. Here, the structural members and the strut may be H-beams.

The structural member can be an H-beam, and the H-beam can be coupled such that a flange of the H-beam is coupled to one side of the steel plate.

A fastening hole can be formed that penetrates the steel plate and the structural member. In this case, a bracket may further be included that is coupled to the other side of the steel plate through the fastening hole.

The horizontal connector can be a C-beam, and the C-beam can be coupled such that a flange of the C-beam faces the structural member.

The vertical connector can be a C-beam, and the C-beam can be coupled such that a flange of the C-beam faces the structural members.

Another aspect of the present invention provides a steel plate concrete wall that includes: a pair of steel plates, which are separated to provide a predetermined space; a structural member, which is positioned in the predetermined space, and which is structurally rigidly joined to one side of the steel plate in the direction of gravity; a strut, which maintains a separation distance between the pair of steel plates; and concrete, which is interposed inside the predetermined space.

The steel plate concrete wall can further include studs protruding from one side of the steel plate.

A multiple number of structural members can be coupled, while the steel plate structure can further include a horizontal connector that interconnects the end portions of the multiple structural members. Also, a vertical connector can further be included that is coupled to an end portion of one side of the steel plate in the direction of gravity.

The structural member can be coupled to one side of the steel plate by welding.

The structural member can include a pair of opposing structural members each coupled to one side of each of the pair of steel plates. In this case, the strut may be coupled between the pair of structural members. Here, the structural members and the strut may be H-beams.

The structural member can be an H-beam, and the H-beam can be coupled such that a flange of the H-beam is coupled to one side of the steel plate.

A fastening hole can be formed that penetrates the steel plate and the structural member. In this case, a bracket may further be included that is coupled to the other side of the steel plate through the fastening hole.

The horizontal connector can be a C-beam, and the C-beam can be coupled such that a flange of the C-beam faces the structural member.

The vertical connector can be a C-beam, and the C-beam can be coupled such that a flange of the C-beam faces the structural members.

Figure 1:
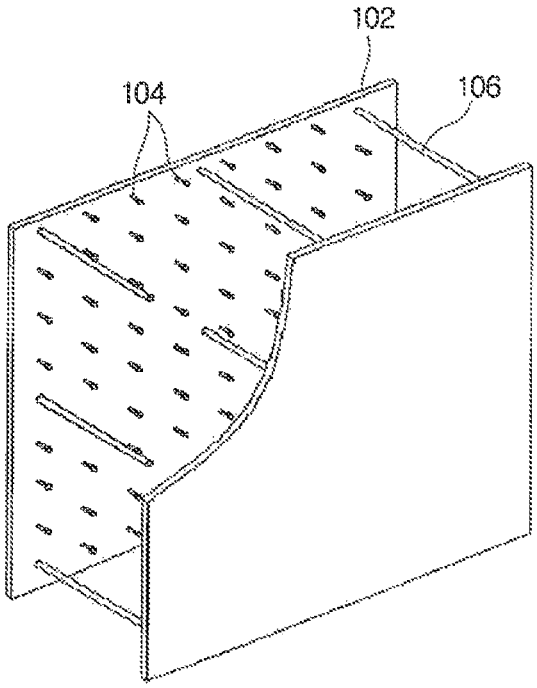
FIG. 1 is a perspective view of a steel plate structure according to prior art, before casting concrete.

| <Description of Numerals for Key Components in the Drawings> | |
|---|---|
| 10: steel plate structure | 12: steel plate |
| 14: structural member | 16: strut |
| 18: stud | 20: bracket |
| 22: bolt | 24: horizontal connector |
| 26: vertical connector | 28: concrete supply part |
| 30: concrete | |

MODE FOR INVENTION

As the invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed in the present invention. In the description of the present invention, certain detailed explanations of related art are omitted when it is deemed that they may unnecessarily obscure the essence of the invention.

The terms used in the present specification are merely used to describe particular embodiments, and are not intended to limit the present invention. An expression used in the singular encompasses the expression of the plural, unless it has a clearly different meaning in the context. In the present specification, it is to be understood that the terms such as "including" or "having," etc., are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added.

The steel plate structure and steel plate concrete wall according to certain embodiments of the invention will be described below in more detail with reference to the accompanying drawings. Those components that are the same or are in correspondence are rendered the same reference numeral regardless of the figure number, and redundant explanations are omitted.

Figure 2:
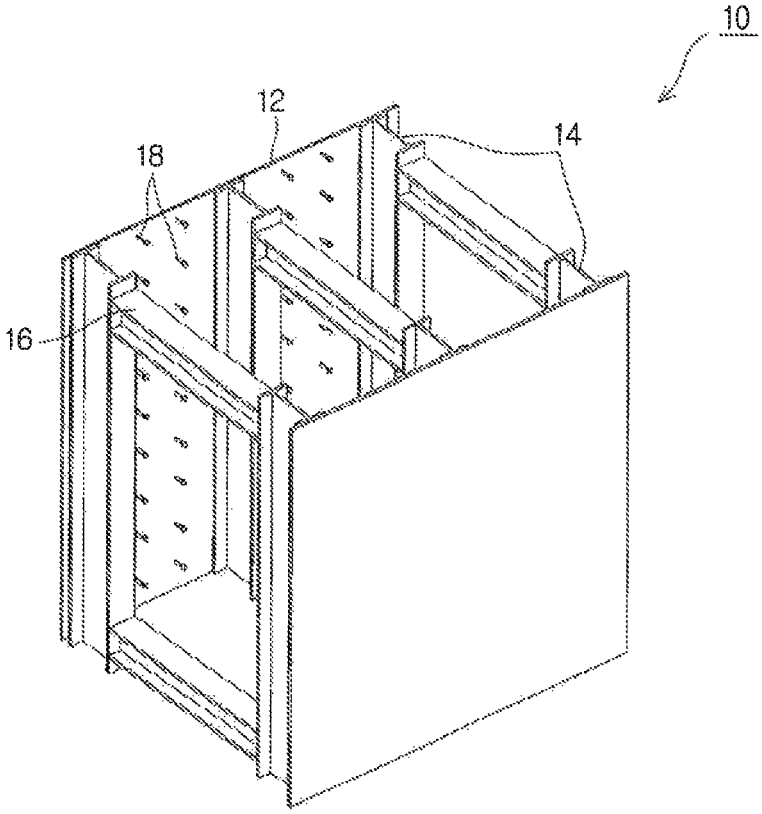
FIG. 2 is a perspective view of a steel plate structure according to a first disclosed embodiment of the present invention.
Figure 3:
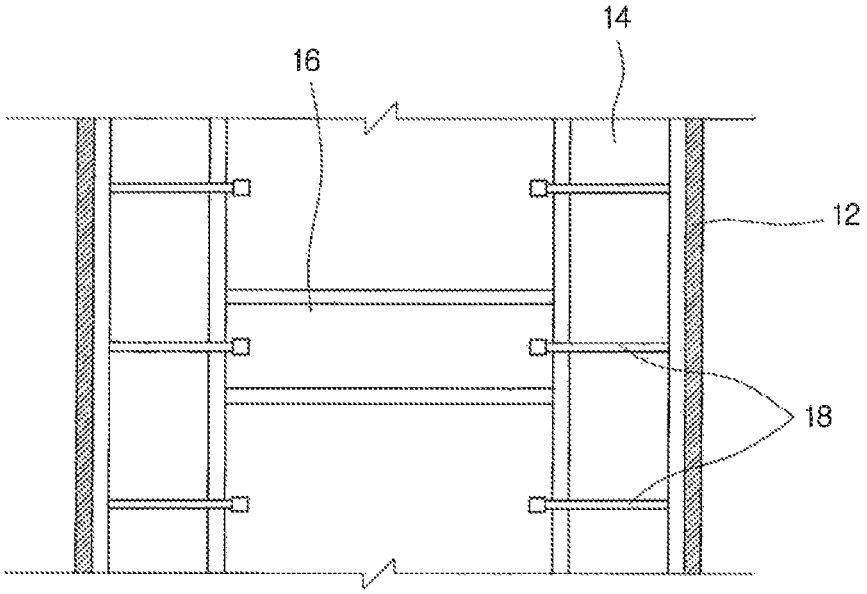
FIG. 3 is a side elevational view of a portion of a steel plate structure according to the first disclosed embodiment of the present invention.
Figure 4:
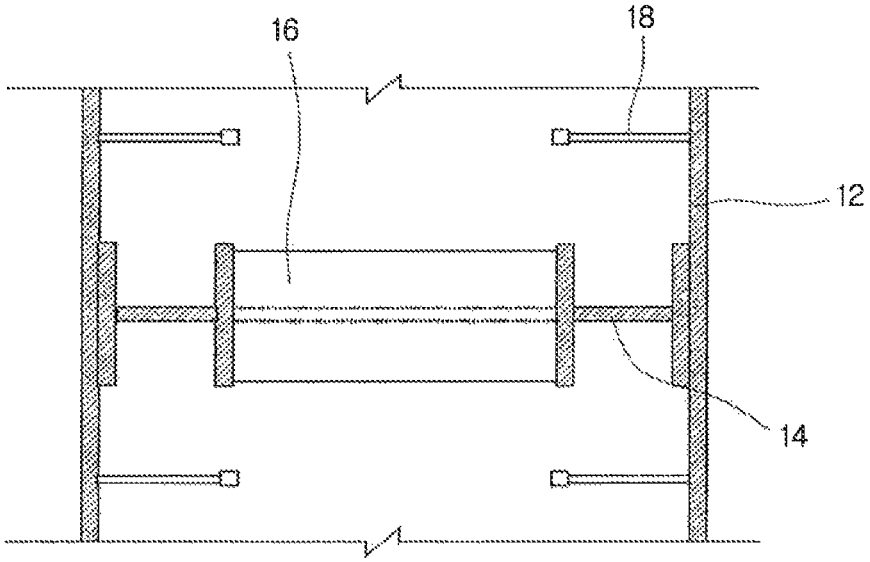
FIG. 4 is a plan view of a portion of a steel plate structure according to the first disclosed embodiment of the present invention.

FIG. 2 is a perspective view of a steel plate structure according to a first disclosed embodiment of the present invention, FIG. 3 is a side elevational view of a portion of a steel plate structure according to the first disclosed embodiment of the present invention, and FIG. 4 is a plan view of a portion of a steel plate structure according to the first disclosed embodiment of the present invention. In FIG. 2 through FIG. 4, there are illustrated a steel plate structure 10, steel plates 12, structural members 14, struts 16, and studs 18.

The present embodiment can be composed of a pair of steel plates 12 that are separated such that a predetermined space is provided, structural members 14 that are positioned in the space and are structurally rigidly joined to one side of a steel plate 12 in the direction of gravity, and struts 16 that maintain a separation distance between the pair of steel plates 12, so that the overall thickness of the steel plate concrete wall can be reduced, so as to allow efficient usage of space, and the thickness of the steel plates can be reduced, so as to reduce thermal deformations during welding attachments. Also, the axial forces or lateral forces acting on the wall can be effectively resisted.

The pair of steel plates may be installed with a distance from each other, to form a predetermined space between the steel plates 12. The predetermined space can be where the concrete may later be cast, and the separation distance between the steel plates 12 can be determined according to the load applied on the steel plate concrete wall. The steel plates 12 may be integrated with the concrete, after the forming of the steel plate concrete wall, to resist the load. Also, these steel plates 12 may restrict the concrete, so that even when the concrete inside undergoes failure, the concrete may be prevented from becoming detached, whereby the load-bearing capability of the steel plate concrete wall may be increased.

The structural members 14 may exist within the predetermined space formed by the pair of steel plates 12, and may be structurally rigidly joined to one side of a steel plate 12 in the direction of gravity. The structural members 14 may resist the load applied on the steel plate concrete wall, together with the steel plates 12 and concrete. The structural members 14 may be arranged in the direction of gravity, to resist the axial forces applied on the steel plate concrete wall, as well as the lateral forces caused by earthquakes, wind, etc. That is, the structural members 14 may be coupled to one side of a steel plate in the longitudinal direction, to resist the load in the axial direction together with the concrete inside the steel plate structure 10 and the steel plates, and as the steel plate concrete wall is rigidly joined to the foundation, to resist shear forces in the lateral directions caused by earthquakes, etc. Also, such structural members 14 may, together with the studs 18 described later, contribute to the integrating of the steel plates 12 and the concrete. Thus, the structural members 14 may serve as structural materials together with the steel plates and the concrete to reduce the overall thickness of the steel plate concrete wall, and may thus be advantageous in forming the walls of a large structure, while the structural members 14 may also reduce the thickness of the steel plates to reduce thermal deformations during welding attachments.

The structural members 14 may be rigidly joined to the steel plate 12, so that the structural members 14 may move as an integrated body with the steel plate 12. Examples of methods for rigidly joining a steel plate 12 with a structural member 14 include rigidly joining the steel plate 12 and the structural member 14 using high-tension bolts or rivets, and welding the structural member 14 to the steel plate 12, to allow integrated movement with the steel plate 12.

Various types of structural beams can be used for the structural members 14, including L-beams, H-beams, I-beams, T-beams, etc. In the present embodiment, H-beams may be used for the structural members 14, with the flanges of the H-beams coupled to one side of a steel plate to form a rigid joint.

The structural members 14 can be structurally rigidly joined to the steel plate 12, in order to prevent deformations in the steel plate structure 10 due to eccentricity or contortion that may occur while transporting to the construction site after manufacture in a factory, and to prevent deformations in the steel plate structure 10 due to transverse pressure applied by unhardened concrete when casting the concrete in the steel plate structure 10.

The structural members 14 can both be rigidly joined to just one of the two steel plates 12 or can be rigidly joined to each of the two steel plates 12. In the case where the structural members 14 are rigidly joined to each of the two steel plates 12, the structural members 14 can be arranged opposite one another, as illustrated in FIG. 2. The number of structural members 14 coupled to one side of a steel plate 12 may be selected in correspondence to the load applied on the steel plate concrete wall.

As the structural members 14 are structurally rigidly joined to the steel plates 12, the combined effect of the steel plates 12, concrete, and structural members 14 may increase the strength against the load, so that a thick wall for a skyscraper structure or a power plant structure, etc., may be formed without increasing the thickness of the steel plates 12. Therefore, as the strength against a large load may be increased without increasing the thickness of the steel plates 12, the thickness of the steel plates 12 can be minimized, to provide easier manufacture and installing of the steel plate structure 10, and the steel plate structure 10 can be modularized, allowing larger module sizes when performing the assembly on site.

The struts 16 may maintain the separation distance between the steel plates 12, whereby the pair of steel plates 12 may provide the predetermined space. The struts 16 can have both ends each coupled to each of the pair of steel plates 12, and in the case where the structural members 14 are coupled to two steel plates in a zigzag configuration, it is possible to couple the ends of the struts to a steel plate 12 and a structural member 14, respectively. Also, in the case where the structural members 14 are arranged opposite each other on two steel plates 12, as illustrated in FIG. 2, the struts 16 can be coupled to the opposing structural members 14.

The struts 16 may maintain the distance between the steel plates 12 in consideration of the thickness of the wall, and may provide an adequate level of strength in consideration of transporting conditions, etc., of the steel plate structure 10. In the case of a wall in a large structure, the increased thickness of the wall can entail a large separation distance between two steel plates 12, and thus beams having a high strength may be used as the struts. In the present embodiment, the structural members 14 and the struts 16 may all be made from H-beams, where the factory manufacture of the steel plate structure 10 can first include coupling the struts 16 to the structural members 14 to form a frame and then include attaching the steel plates 12 to the structural members 14, so that the manufacturing process may be shortened.

Various types of structural beams can be used for the struts 16, including L-beams, C-beams, H-beams, I-beams, T-beams, etc. In the present embodiment, H-beams may be used for the struts 16, the same as for the structural members 14.

According to the size of the wall to be formed, the steel plate structure 10 according to the present embodiment can be manufactured directly on site, or manufactured as a unit module at a factory, with the multiple unit modules assembled on site to form a wall. The case of forming the steel plate structure 10 as a unit module will be described later in more detail with reference to FIG. 7.

The studs 18 may be buried inside the concrete so as to allow the steel plates 12 and the concrete to move in an integrated manner, in order that the combined effect of the steel plates 12 and the concrete may resist external loads. The studs 18 may be buried uniformly over one side of a steel plate 12, so that the concrete and the steel plate 12 may move as an integrated body over the entire surface.

As described above, in the case where the structural members 14 are rigidly joined to one side of the steel plate 12, the structural members 14 may contribute to the integrating of the concrete with the steel plate 12. If beams having a large area of contact with the concrete, such as H-beams, I-beams, C-beams, etc., are used for the structural members 14, it may be possible to integrate the steel plates 12 and the concrete with just the structural members 14, and the coupling of the studs 14 may be omitted. Of course, it is possible to reduce material costs by coupling only the required number of studs 18, in consideration of the degree by which the structural members 14 contribute to the integration between the steel plates 12 and the concrete.

In the case where the steel plate structure 10 is to be manufactured on site to form a wall, the steel plate structure 10 can be assembled over the foundation plate for forming the wall, after which concrete can be cast in between the steel plates 12 to form a steel plate concrete wall.

Conversely, it is also possible to manufacture the steel plate structure 10 according to the present embodiment as a unit module at a factory, transport the unit modules to the construction site, and attaching the unit modules on site to form a wall. In this case, since the corresponding structural members 14 of the unit modules have to be connected in an integrated manner to transfer loads, the lower ends of the structural members 14 of the unit modules arranged on top and the upper ends of the structural members 14 of the unit modules arranged on the bottom may be given the same cross sections and afterwards rigidly joined, so that the forces in the structural members 14 may be efficiently transferred to the ground.

Figure 5:
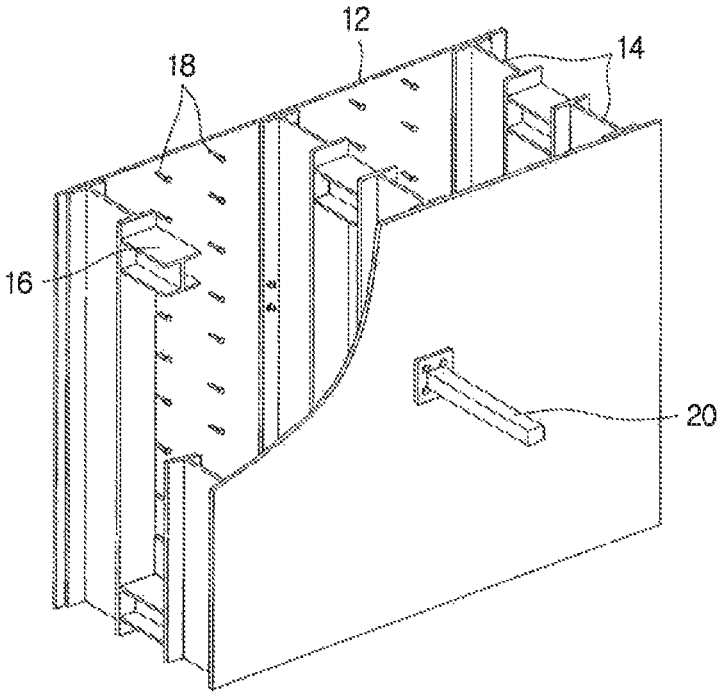
FIG. 5 is a perspective view of a steel plate structure having a bracket attached according to the first disclosed embodiment of the present invention.
Figure 6:
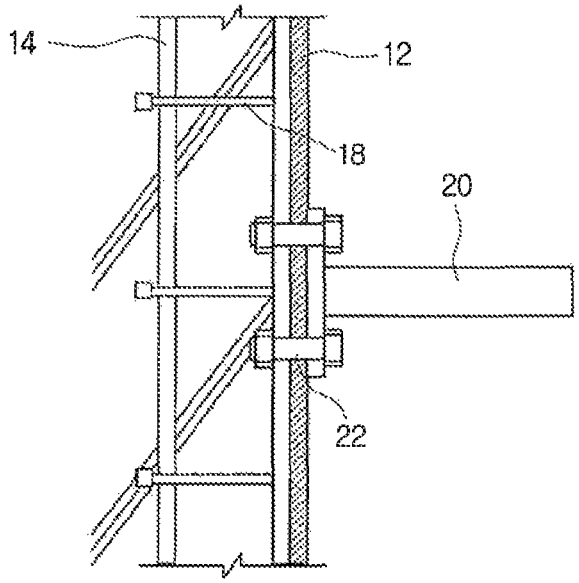
FIG. 6 is a side elevational view of a portion of a steel plate structure having a bracket attached according to the first disclosed embodiment of the present invention.

FIG. 5 is a perspective view of a steel plate structure having a bracket attached according to the first disclosed embodiment of the present invention, and FIG. 6 is a side elevational view of a portion of a steel plate structure having a bracket attached according to the first disclosed embodiment of the present invention. In FIG. 5 and FIG. 6, there are illustrated steel plates 12, structural members 14, struts 16, studs 18, a bracket 20, and bolts 22.

For a high-rise building, a factory building, a nuclear power plant structure, etc., there are many occasions when an external device, such as an electrical facility, communication facility, piping, etc., is installed on the wall, and in order to install an external device such as piping, etc., onto the outside of a steel plate concrete wall, a bracket for supporting the external device may be welded or coupled with bolts 22 to a steel plate 12. However, when installing a large external device having a heavy mass onto the bracket 20, the mass of the external device may often cause local deformations in the steel plate 12 and degrade the load-bearing performance.

Therefore, in the present embodiment, fastening holes can be prepared, which penetrate the steel plates 12 and the structural members 14, so that the bracket 20 may be coupled to the steel plate 12 through the fastening holes using rivets or bolts 22, making it possible to support a heavy external device. That is, as illustrated in FIG. 6, fastening holes for securing the bracket 20 may be formed in portions of the steel plate 12 where a structural member 14 is rigidly joined, and the bracket 20 may be coupled through the fastening holes, to allow the steel plate 12 and the structural member 14 to support the external device together.

This bracket 20 may be installed after the steel plate structure 10 is installed in the position for forming the wall but before casting the concrete, or may be installed after the concrete is cast and cured.

Of course, it is also possible to install the bracket 20, to support a small external device, by forming fastening holes in portions of the steel plate 12 where a structural member 14 is not rigidly joined.

Figure 7:
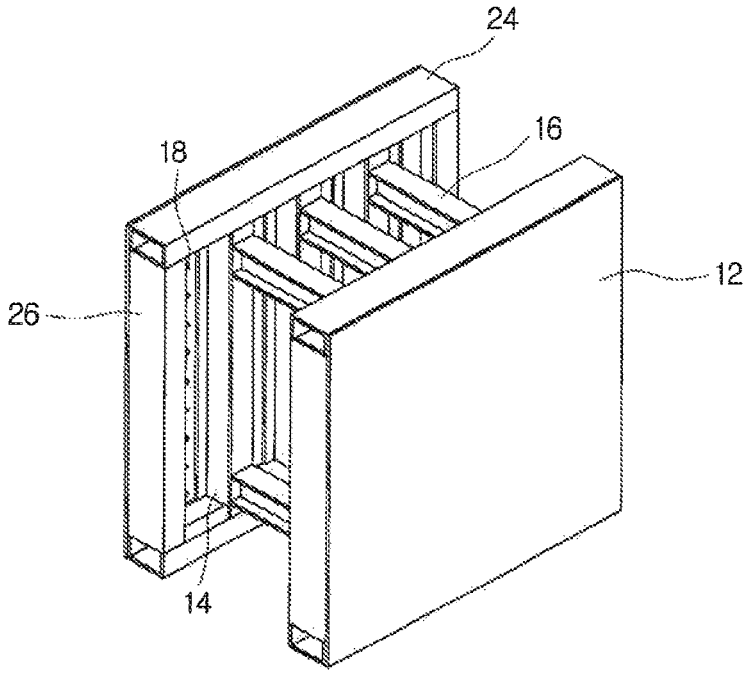
FIG. 7 is a perspective view of a steel plate structure according to a second disclosed embodiment of the present invention.
Figure 8:
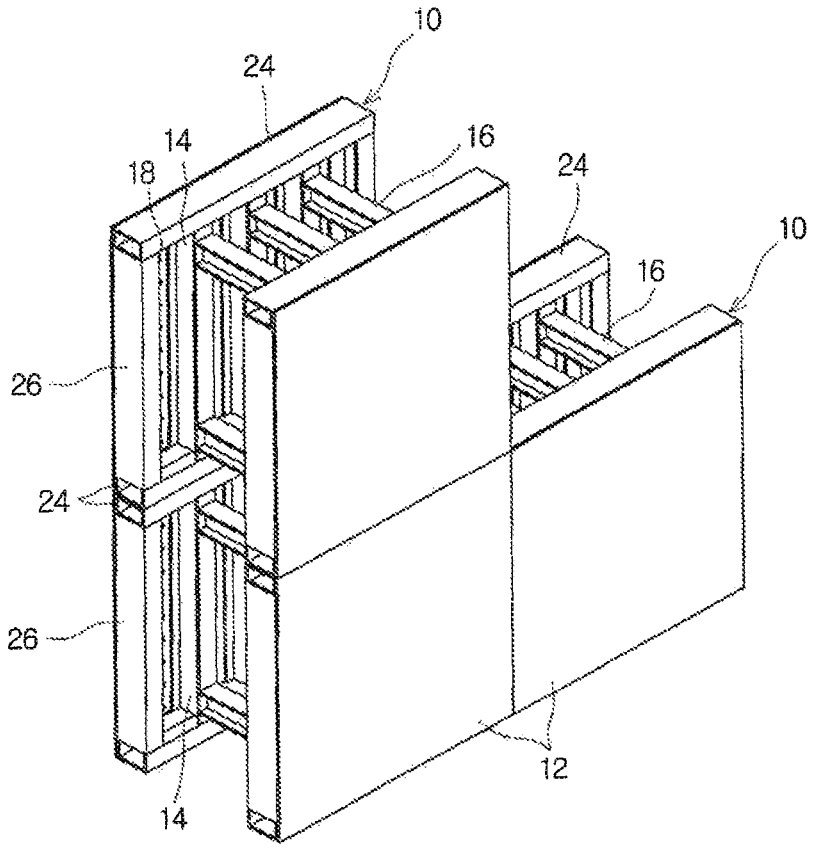
FIG. 8 is a perspective view illustrating multiple steel plate structures coupled together according to the second disclosed embodiment of the present invention.
Figure 9:
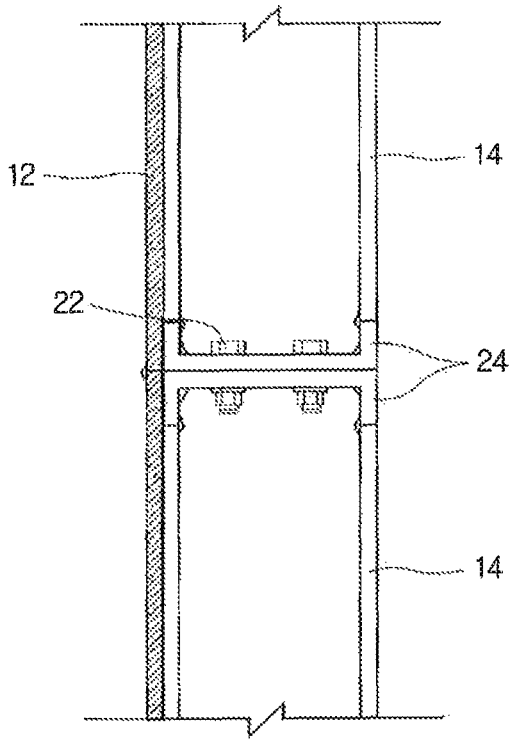
FIG. 9 is a drawing illustrating the horizontal connectors of steel plate structures coupled together according to the second disclosed embodiment of the present invention.
Figure 10:
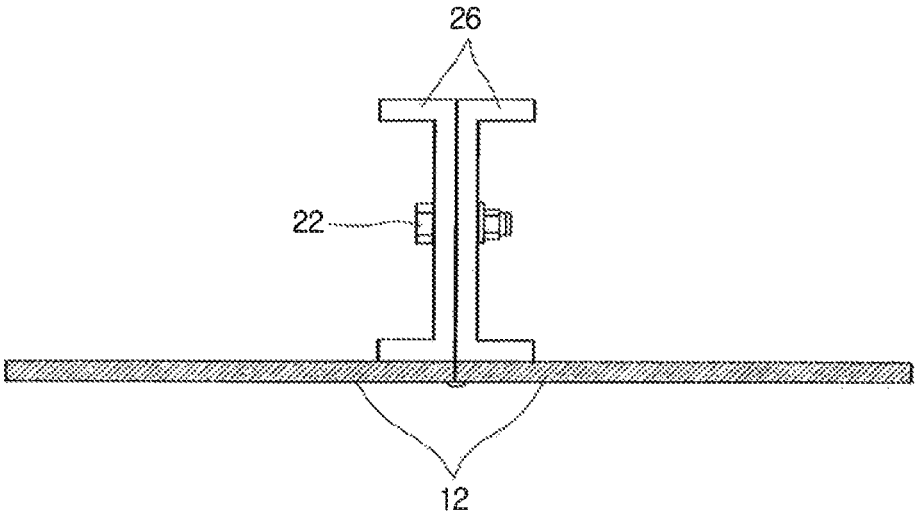
FIG. 10 is a drawing illustrating the vertical connectors of steel plate structures coupled together according to the second disclosed embodiment of the present invention.

FIG. 7 is a perspective view of a steel plate structure according to a second disclosed embodiment of the present invention, FIG. 8 is a perspective view illustrating multiple steel plate structures coupled together according to the second disclosed embodiment of the present invention, FIG. 9 is a drawing illustrating the horizontal connectors of steel plate structures coupled together according to the second disclosed embodiment of the present invention, and FIG. 10 is a drawing illustrating the vertical connectors of steel plate structures coupled together according to the second disclosed embodiment of the present invention. In FIG. 7 through FIG. 10, there are illustrated steel plate structures 10, steel plates 12, structural members 14, struts 16, studs 18, horizontal connectors 24, vertical connectors 26, and bolts 22.

In the present embodiment, the steel plate structures 10 may be manufactured at a factory as a unit module, after which the unit modules may be transported to the construction site, the unit modules for the steel plate structures 10 may be assembled to manufacture bigger modules, the bigger modules may be hauled and installed in the final positions, and concrete may be cast, to complete a steel plate concrete wall. That is, as illustrated in FIG. 8, unit modules arranged up and down can be coupled using horizontal connectors 24, while unit modules arranged side by side can be coupled using vertical connectors 26, and with a number of unit modules coupled together in accordance to the desired size of the wall, concrete can be cast in to form a steel plate concrete wall.

Multiple structural members 14 can be coupled in the steel plate structures 10 in predetermined intervals, and horizontal connectors 24 can be installed that interconnect the end portions of the multiple structural members 14, to efficiently transfer the forces in the structural members 14 and provide easier assembly between the unit modules of the steel plate structures 10.

Also, for horizontal coupling between the steel plate structures 10 implemented as unit modules, vertical connectors 26 can be included that are each coupled in the direction of gravity to an end portion on one side of a steel plate. When attaching unit modules together, coupling the vertical connectors 26 to one another can increase the cross sectional area of the coupling surface, and when the attachment between unit modules is complete, the vertical connectors 26 may resist the loads applied on the steel plate concrete wall, together with the structural members 14 described above.

The horizontal connectors 24 can be for interconnecting unit modules that are arranged up and down, and the vertical connectors 26 can be for interconnecting unit modules that are arranged side by side, where the coupling between horizontal connectors 24 and the coupling between vertical connectors 26 may form structurally rigid joints.

The horizontal connectors 24 and vertical connectors 26 can be attached to the end portions of the unit modules, and can perform a structural function of preventing deformations in the steel plates during the welding for attaching the steel plates of the unit modules together.

Examples of methods for coupling horizontal connectors 24 to each other or coupling vertical connectors 26 to each other include rigid joining using high-tension bolts 22 or rivets, and rigid joining by welding. In the present embodiment, high-tension bolts 22 were used in coupling the unit modules together, as illustrated in FIG. 9 and FIG. 10, to provide easier assembly on site.

Various types of structural beams can be used for the horizontal connectors 24 and vertical connectors 26, including L-beams, H-beams, C-beams, I-beams, T-beams, etc.

As illustrated in FIG. 9, in the present embodiment, H-beams may be used for the structural members 14, while C-beams may be used for the horizontal connectors 24, with the web of the end portion of the H-beam inserted in the channel portion of the C-beam such that the flanges of the C-beam face the structural member 14, so that the attachment area between the structural member 14 and the horizontal connector 24 may be increased and the webs of the C-beams may be placed in surface contact with each other, in order that the forces in the members may readily be transferred. Fastening holes can be formed beforehand for coupling the horizontal connectors 24 using bolts 22 or rivets, when manufacturing the steel plate structures 10 implemented as unit modules at the factory.

Also, as illustrated in FIG. 10, C-beams may be used for the vertical connectors 26, and the flanges of the C-beam may face the structural member 14, so that the attachment area between the flange of the C-beam and the one side of the steel plate may be increased and the webs of the C-beams positioned side by side may be placed in surface contact with each other, in order that the forces in the members may readily be transferred. That is, when attaching the unit modules, coupling the vertical connectors 26 to one another can increase the cross sectional area of the coupling surface, to a form similar to an H-beam, and when the attachment between unit modules is complete, the vertical connectors 26 may resist the loads applied on the steel plate concrete wall, together with the structural members 14 described above.

Fastening holes can be formed beforehand for coupling the horizontal connectors 24 using bolts 22 or rivets, when manufacturing the steel plate structures 10, implemented as unit modules, at the factory.

As described above, fastening holes may be prepared, which penetrate the steel plate 12 and the structural member 14, so that a bracket may be coupled to the steel plate 12 through the fastening holes using rivets or bolts, whereby the steel plate 12 and the structural member 14 rigidly joined to the steel plate 12 may support an external device together, making it possible to support an external device having a heavy mass.

Figure 11:
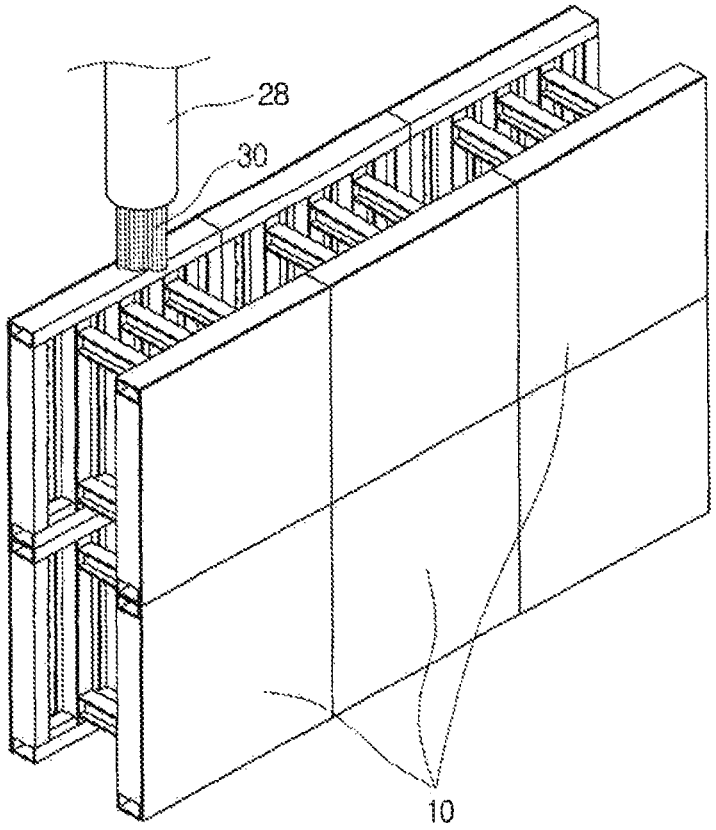
FIG. 11 is a drawing illustrating the construction of a steel plate concrete wall according to a third disclosed embodiment of the present invention.

FIG. 11 is a drawing illustrating the construction of a steel plate concrete wall according to a third disclosed embodiment of the present invention. In FIG. 11, there are illustrated steel plate structures 10, concrete 30, and a concrete supply part 28.

With the steel plate structures 10 implemented as a unit module, several unit modules can be assembled to form a wall of a predetermined size. That is, the steel plate structure 10 implemented as unit modules may be manufactured in a required number, after which the unit modules may be transported to the construction site, the steel plate structures 10 as unit modules may be assembled into a bigger module, the bigger modules may be hauled and installed in the final positions, and concrete 30 may be cast by way of the concrete supply part 28, to form a steel plate concrete wall.

Manufacturing the steel plate structures 10 in a factory may allow easier quality management to provide high-quality steel plate structures 10, and as the work on site may be minimized, the construction time can be reduced.

While the spirit of the invention has been described in detail with reference to particular embodiments, the embodiments are for illustrative purposes only and do not limit the invention. It is to be appreciated that those skilled in the art can change or modify the embodiments without departing from the scope and spirit of the invention.

INDUSTRIAL APPLICABILITY

By utilizing load-bearing structural members together with the steel plates and concrete, the overall thickness of the steel plate concrete wall can be reduced, to allow a more efficient use of space.

Also, the thickness of the steel plates can be reduced, allowing better welding properties and larger unit module sizes.

Also, the axial forces or lateral forces applied on the steel plate concrete wall may be effectively resisted.

Furthermore, in the case where the steel plate structure is implemented as a unit module, horizontal connectors or vertical connectors may be arranged at the end portions of the steel plates, to facilitate the attaching between unit modules and allow the forces in the structural members to be transferred directly between unit modules, whereby the strength of the wall may be increased.

Also, a bracket may be installed utilizing the strengths of the steel plate and the structural member, so that heavy external devices, such as piping or electrical facilities, etc., may be supported effectively.

The invention claimed is:

1. A steel plate concrete wall comprising:

a pair of steel plates separated such that a predetermined space is provided;

a plurality of structural members positioned in the predetermined space and structurally rigidly joined to one surface of one of the pair of steel plates in a direction of gravity, each of the plurality of structural members being an H-beam;

struts maintaining a separation distance between the pair of steel plates;

a horizontal connector interconnecting end portions of the plurality of structural members, said horizontal connector having a surface abutting an end portion of one of the pair of steel plates in a latitudinal direction;

a vertical connector coupled to an end portion of one of the pair of steel plates in a direction of gravity; and concrete interposed within the predetermined space;

wherein the pair of steel plates, the plurality of structural members, and the struts constitute a unit module;

wherein the horizontal connector and the vertical connector couple the unit module with another unit module.

2. The steel plate concrete wall according to claim 1, further comprising studs protruding from one surface of each of the pair of steel plates.

3. The steel plate concrete wall according to claim 2, wherein the horizontal connector is a C-beam, and the C-beam is coupled such that a flange of the C-beam faces the plurality of structural members.

4. The steel plate concrete wall according to claim 1, wherein the vertical connector is a C-beam, and the C-beam is coupled such that a flange of the C-beam faces one of the plurality of structural members.

5. The steel plate concrete wall according to claim 1, wherein the plurality of structural members are coupled to the one surface of one of the pair of steel plates by welding.

6. The steel plate concrete wall according to claim 1, wherein the plurality of structural members each include a pair of opposing structural members each coupled to one surface of each of the pair of steel plates.

7. The steel plate concrete wall according to claim 6, wherein the struts are coupled between the pair of structural members.

8. The steel plate concrete wall according to claim 1, wherein the plurality of structural members are each an H-beam, and the H-beam is coupled such that a flange of the H-beam is coupled to one surface of the pair of steel plates.

9. The steel plate concrete wall according to claim 1, further comprising: fastening holes penetrating the pair of steel plates and the plurality of structural members.

10. The steel plate concrete wall according to claim 9, further comprising: a bracket coupled to one surface of the other of the pair of steel plates through the fastening holes.

* * * * *